US007168745B2

(12) United States Patent
Jamnia et al.

(10) Patent No.: US 7,168,745 B2
(45) Date of Patent: Jan. 30, 2007

(54) DEVICE FOR LATCHING A CABINET DOOR

(76) Inventors: Mohammad Ali Jamnia, 4642 N. Hermitage Ave., Chicago, IL (US) 60640; Jack Chen, 14 Kimberly Cir., Oak Brook, IL (US) 60521; Patrick Forster, 229 N. Lincoln, Westmont, IL (US) 60559; Kenneth G. Such, 231 Biltmore Dr., North Barrington, IL (US) 60010; Joe Chu, 142. Spring Ave., Glen Ellyn, IL (US) 60137

( * ) Notice: Subject to any disclaimer, the term of this patent is extended or adjusted under 35 U.S.C. 154(b) by 49 days.

(21) Appl. No.: 10/952,094

(22) Filed: Sep. 28, 2004

(65) Prior Publication Data

US 2006/0071483 A1 Apr. 6, 2006

(51) Int. Cl.
*E05C 19/00* (2006.01)
*E05B 3/00* (2006.01)

(52) U.S. Cl. ..... 292/302; 292/116; 292/156; 292/336; 292/DIG. 68

(58) Field of Classification Search ..... 292/302, 292/116, 117, 56, 161, 156–158, 300, 341.15, 292/341.18, 341.19, DIG. 46, DIG. 68, 336
See application file for complete search history.

(56) References Cited

U.S. PATENT DOCUMENTS 262,409 A * 8/1882 Hawkins ..... 292/336
1,438,547 A * 12/1922 O'Connor ..... 292/161
1,515,611 A * 11/1924 O'Connor ..... 70/81
1,515,612 A * 11/1924 O'Connor ..... 292/335
1,671,328 A * 5/1928 Sturm et al. ..... 292/162
1,677,278 A * 7/1928 Foehrenbach ..... 292/162
1,766,193 A * 6/1930 Schmitz et al. ..... 292/24
1,774,783 A * 9/1930 Worley, Jr. et al. ..... 70/82
1,932,468 A * 10/1933 Knell ..... 70/81
2,033,806 A * 3/1936 Baker et al. ..... 292/33
2,153,088 A * 4/1939 Knell ..... 292/150
2,370,841 A * 3/1945 Chervenka ..... 292/19
2,498,508 A * 2/1950 Rudolph ..... 292/31
2,518,141 A * 8/1950 Hiler ..... 70/79
2,740,284 A * 4/1956 Gray ..... 70/79
2,868,577 A * 1/1959 Zingone ..... 292/99
3,140,889 A * 7/1964 Sanders ..... 292/128
3,158,016 A * 11/1964 Fay ..... 70/82
3,367,698 A * 2/1968 Walker, Sr. ..... 292/188
3,722,236 A * 3/1973 Zelenko ..... 70/78

(Continued)

*Primary Examiner*—Brian E. Glessner
*Assistant Examiner*—Carlos Lugo
(74) *Attorney, Agent, or Firm*—Robert L. Marsh

(57) ABSTRACT

A vending machine cabinet is retained in a closed position by a hook that is engaged by a vertically moveable latch bar that can be latched closed without requiring a solenoid. The latch bar is moved by means of a cam attached to one of the hooks. Prior to engaging the hook, an angled surface of the cam engages a surface defined by the opening in the latch bar. As the door is closed, the cam rotates through an angle thereby lifting the latch bar until the upwardly extending finger of the hook can move through the opening of the latch bar. When the door is fully closed, the surface of the cam is moved from beneath the edge of the opening in the latch bar thereby allowing the latch bar to drop behind the hook, latching the door closed.

14 Claims, 8 Drawing Sheets

U.S. PATENT DOCUMENTS 4,025,096 A * 5/1977 Geer ..... 292/158
4,500,122 A * 2/1985 Douglas ..... 292/161
5,201,557 A * 4/1993 Schlack ..... 292/161
5,375,894 A * 12/1994 Schlack ..... 292/36
5,542,720 A * 8/1996 Fleming ..... 292/32
6,149,213 A * 11/2000 Sokurenko et al. ..... 292/340
6,362,975 B1 * 3/2002 Liu et al. ..... 361/796
6,637,784 B1 * 10/2003 Hauber et al. ..... 292/300
6,637,785 B1 * 10/2003 Sugimoto ..... 292/336.3
6,935,662 B1 * 8/2005 Hauber et al. ..... 292/302
2002/0163208 A1 * 11/2002 Quigley et al. ..... 292/302
2006/0006677 A1 * 1/2006 Washington et al. ..... 292/300

* cited by examiner

DEVICE FOR LATCHING A CABINET DOOR

The present invention relates to a device for mechanically latching a vending machine cabinet door closed, where the latch comprises a stationary hook and a latch bar having a latch plate that is longitudinally moved in a vertical direction to release the plate from behind the hook and moved in a downward direction to become locked behind the hook.

BACKGROUND OF THE INVENTION

Vending machines are used as an outlet for retail goods, including packaged foods, desserts, candies, soft drinks, toys, and stamps and to wash and dry clothing. An operator of vending machines may have a hundred or more machines under his or her control, each of which must be routinely visited to supply inventory, remove cash, and verify that the machine is in good operating condition. Between such visits, however, the machine is accessible to the public, including thieves.

Existing machines consist of an enclosure with the forward surface of which openable as a door for replenishing the magazines with goods and for removing cash. A hook retains the door in the closed position and is openable using a key. Although the enclosures and locks for such machines are constructed to discourage unauthorized entry, a professional thief will study the construction of such enclosures and locks and find the weakest portion of their construction, which is usually at the lock. A professional thief, having knowledge of the weaknesses of a vending machine and carrying proper tools, can defeat the lock of an existing vending machine and access its magazine and cash box within seconds.

A sturdy locking device is needed to retain the door of the vending machine cabinet closed. Currently, two structures are in use for locking such cabinets. The first structure consists of a screw mounted on the door or the frame of the enclosure and a complementary nut on the other member, with the screw tightened or untightened into the nut to lock or unlock the door. The screw may be manually or electrically rotated, however, one disadvantage of manually operated screws is that the location of the handle to turn the screw is readily visible from the exterior of the cabinet.

The alternative method for latching a vending machine cabinet includes an upwardly directed, rigidly mounted hook positioned on either the door or the cabinet and a vertically moveable latch bar on the other member. The latch bar has a plate that is lifted and moved behind the hook and lowered to latch the door. One advantage of the latch bar is that the bar can engage a plurality of hooks spaced along its length, and the locations of the hooks cannot be determined without opening the enclosure. A disadvantage of the latch bar is that the latch bar must be lifted from a lower position to its upper position by turning a lever arm each time the door is either opened or closed.

With the advent of handheld electronic transmitters and the like, it has become increasingly popular to hide an electronic receiver in the exterior of a cabinet for receiving a signal from an electronic key to open the door of a vending machine. When the door is latched closed with a slide bar, the electronics within the machine include the concealed detector for receiving an electronic signal, a microprocessor containing logic in which the signal received is compared to a code stored in memory. If the signal received matches the code in the memory, the electronics of the machine will energize a solenoid to raise the slide bar thereby lifting the latch plate from behind the hooks that retain the door closed.

Such machines normally retain the slide bar in the elevated position for a fixed period of time after which the solenoid is de-energized and the slide bar is allowed to drop to its lower position.

When a technician services a vending machine, the door will be open for several minutes while the magazines of the machine are refilled and the cash in the coin box removed. The technician may also undertake minor repairs to the equipment of the machine and verify that its components operate properly. The timing device of the machine, which controls the operation of the solenoid, maintains the solenoid in the open position for a very short period of time to minimize the risk of unauthorized invasion into the cabinet. Accordingly, the slide bar is usually dropped by the solenoid to its lower position long before the technician is ready to close the cabinet, and therefore the slide bar must again be lifted until the door has been closed and the latch plate again positioned behind the hooks.

Where a vending machine cabinet is provided with a slide bar that is electronically operated, the slide bar includes a mechanical backup for operating the slide bar and unlatching the door in the event of the failure of the electronics that operate the solenoid. The location of the mechanical backup, however, is concealed so it is not readily accessible to thieves. The mechanical backup requires a template to locate a point at which a hole can be drilled in the machine through which a tool can be inserted to mechanically lift the slide bar. A vending machine cabinet fitted with a slide bar-type latch, therefore, can only be closed by either operating the electronic transmitter for a second time as the door is closed, or by providing a mechanical structure which will engage the slide bar and raise the slide bar over the hook as the door is moved from an ajar position to a closed position.

The technicians that service vending machines are often employed by a service agency or by the owner of the machine who wish to retain a degree of supervision over the activities of the technician. The electronics in the machine and in the handheld key may therefore include one or more programs to monitor the amount of cash received into the cash box between services dates of the machine. Where this is done, it is also desirable that the machine be capable of distinguishing between a latching and an unlatching event. To simplify this distinction, it is preferable that the cabinet door of a vending machine having a slide bar-type latch includes a mechanical method for raising the slide bar as the door is closed so that a subsequent actuation of the solenoid is not required. One obvious method of providing a mechanical means for raising the slide bar is to provide a ramp surface that extends outward of the hook that will engage a lower edge of an opening in the slide bar. As the door of the cabinet is closed, the slide bar will be lifted by the ramp surface until the latch plate can fall behind the hook. The problem with this structure is that it requires that a rigid tapered member extend outward of either the door or the enclosure, which may cause injury to a technician or to an innocent bystander. It would be desirable, therefore, to provide a mechanical means for lifting the slide bar that does not rely upon a rigid ramp surface.

SUMMARY OF THE INVENTION

Briefly, the present invention is embodied in a device for unlatching a door against an enclosure that includes a hook mounted on one of the door and the enclosure and a moveable latch bar on the other of the door and the enclosure. The moveable latch bar includes a latch plate that is engagable behind the hook when the door is in the closed position to retain the door. The latch bar is urged into the latching position by either the force of gravity drawing the bar downwardly, or by a spring. A cam is provided on the door or the enclosure having the hook mounted thereon. The cam has an axis of rotation and a surface having a component parallel to the axis. The surface of the cam will engage a surface on the slideable latch bar as the door is moved into an ajar position. As the door is subsequently closed, the cam will be rotated about its axis and as the cam rotates, the surface of the cam will lift the slide bar into the unlatched position, thereby allowing the hook to move behind the latch plate. Once the door has reached the fully closed position, the cam will be pulled away from the surface of the latch plate thereby allowing the latch plate to return to the engaged position, and the spring or gravity will return the cam to its standby orientation.

BRIEF DESCRIPTION OF THE DRAWINGS

A better understanding of the invention will be had after a reading of the following detailed description taken in conjunction with the drawings wherein.

DETAILED DESCRIPTION OF A PREFERRED EMBODIMENT

Figure 1:
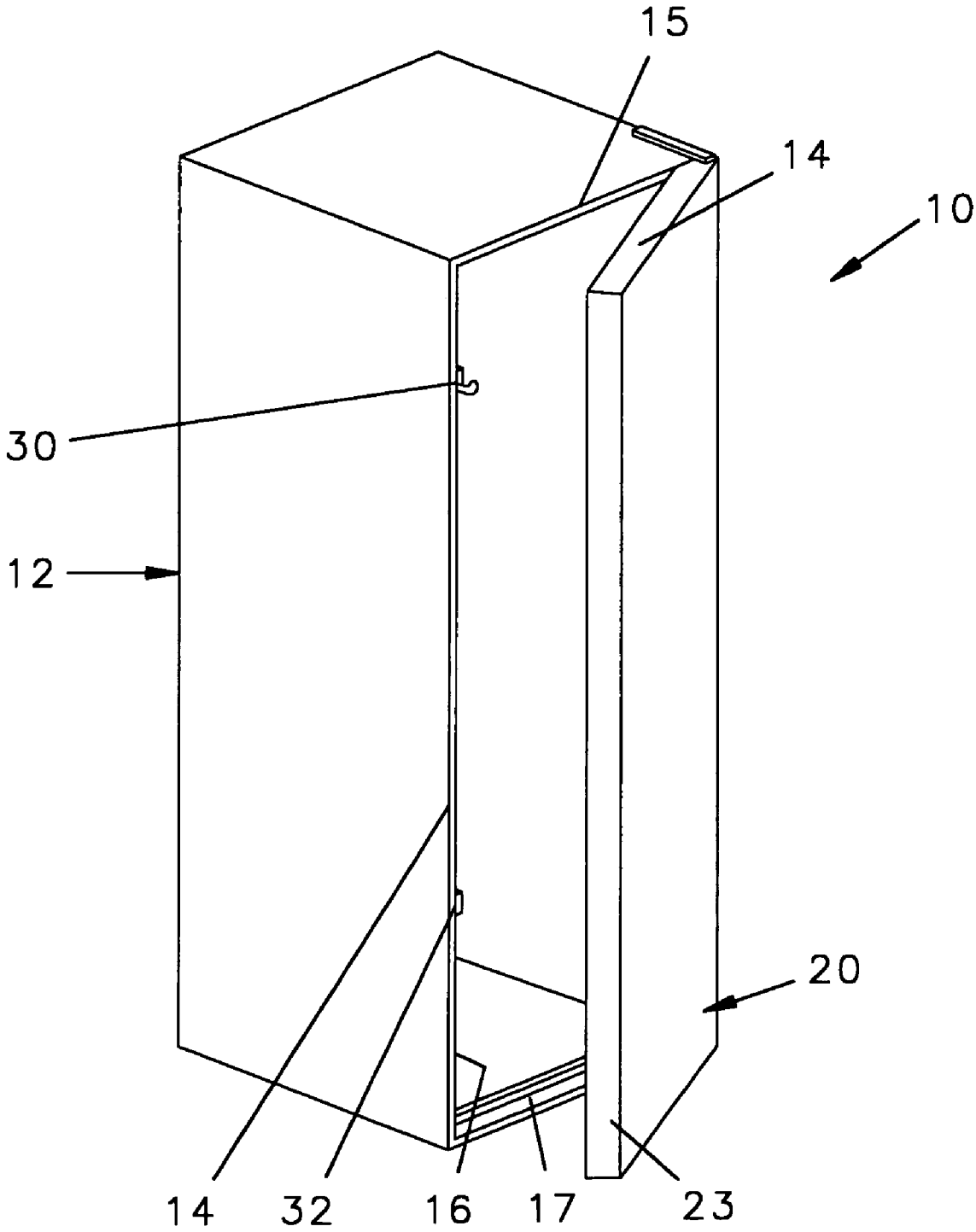
FIG. 1 is an isometric view of a vending machine cabinet showing the door thereof partially open, exposing the engagement hooks and a cam in accordance with the invention.
Figure 2:
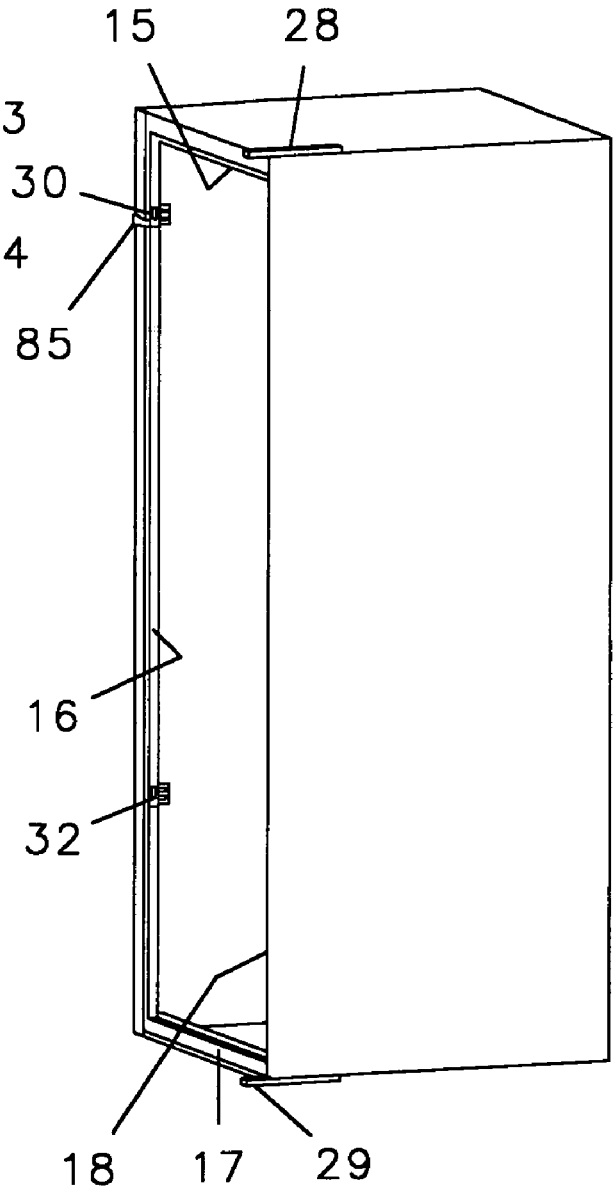
FIG. 2 is an isometric view of the cabinet shown in FIG. 1 with the door removed, the cabinet viewed from an angle that allows the hooks to be more visible.

Referring to FIGS. 1 through 4, a vending machine has a cabinet 10 consisting of a generally box-shaped enclosure 12 having an opening 14 defined by four framed surfaces 15, 16, 17, 18. Fitted against the frame surfaces 15–18 and across the opening 14 of the enclosure 12 is a door 20 having an inner end 22 and an outer end 23, and upper and lower ends 24, 25. The inner end 22 of the door 20 is mounted by upper and lower pins 26, 27 to a pair of hinge members 28, 29 allowing the door to move from an open position, shown in FIG. 1, to a closed position, not shown, in which the outer end 22 of the door abuts against the complimentary frame surface 16 of the opening 14 and the upper and lower ends 24, 25 of the door abut against the upper and lower frame members 15, 16 to thereby entirely close the opening 14 of the cabinet 10. The door 20 is retained in the closed position by at least two hooks 30, 32 mounted to an inner surface of the cabinet adjacent the long frame surface 16 that are engaged by surfaces on a slide bar 34 slideably mounted to the inner surface 36 of the door 20.

Figure 7:
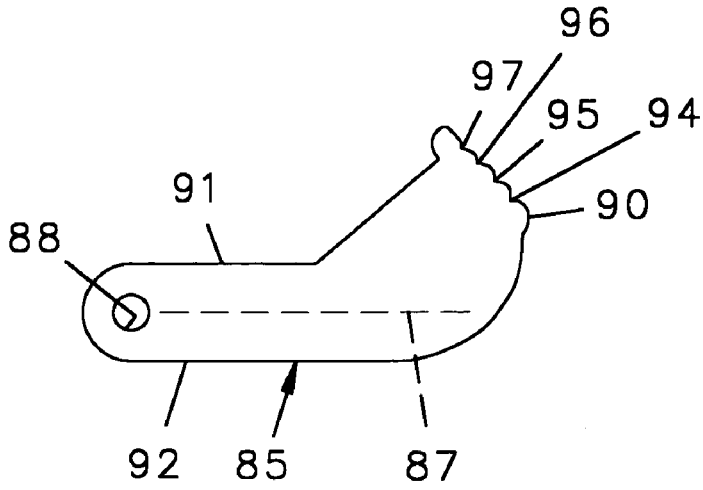
FIG. 7 is a front elevational view of a cam first shown in FIG. 1 for lifting the latch bar shown in FIG. 3.
Figure 8:
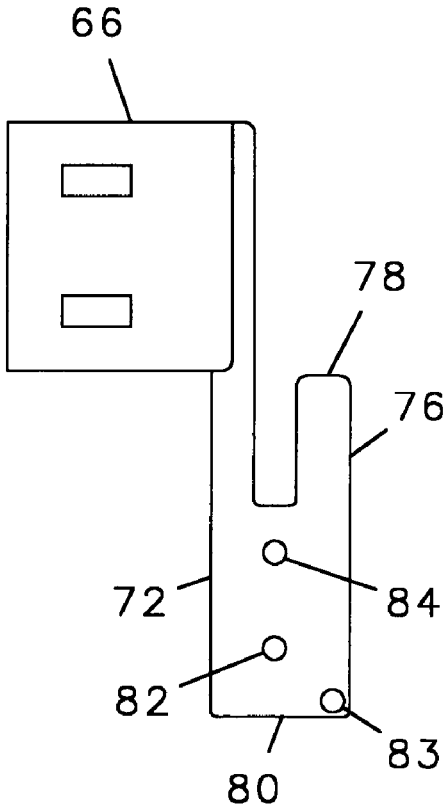
FIG. 8 is a front elevational view of a hook to which the cam shown in FIG. 7 is attached.
Figure 9:
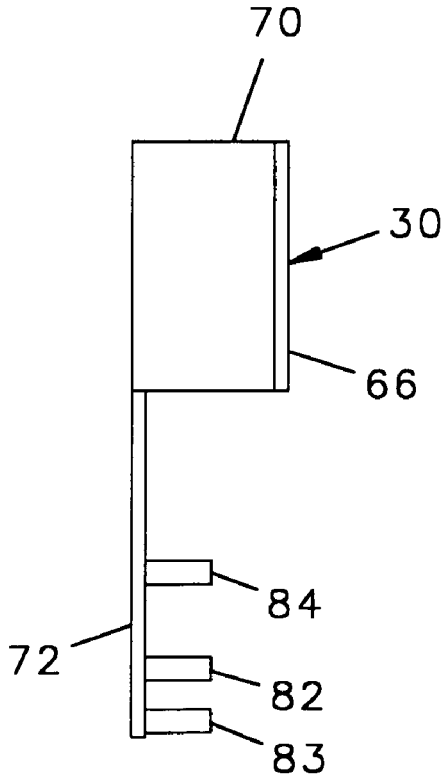
FIG. 9 is a side elevational view of the hook shown in FIG. 8.
Figure 10:
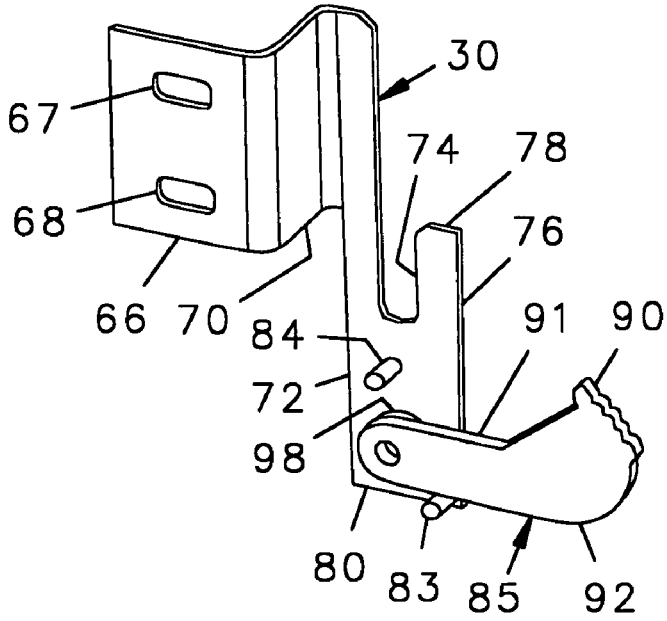
FIG. 10 is an enlarged isometric view of the hook and cam assembly disconnected from the enclosure.

Referring to FIG. 7, each hook 30, 32 is preferably made of metal, and preferably stamped from steel plate. Each of hooks 30, 32 include an attachment plate 66 having a plurality of transverse holes 67, 68 therein for receiving screws, not shown, for attaching the plates 66 of the hooks 30, 32 to the inner surface of the enclosure 12. Extending from one side of the attachment plate 66 is a shoulder portion 70 adapted to offset the hooks so as to be engagable by the slide bar as described below. Attached to the outer end of the shoulder 70 of each hook 30, 32 is a generally planar hook plate 72 having an elongate downwardly extending cut out portion 74 therein so as to leave an upwardly extending tooth 76 having an upper end 78 and a lower end 80.

The hook plate 72 of one hook 30 is adapted to receive a rotatable cam 85. The hook plate 72 of hook 30 has extending perpendicularly outwardly of one surface thereof, in generally parallel relationship, three pins 82, 83, 84. Pin 82, located near the lower end of the hook plate 72 and near the junction with the shoulder portion 70, is the pivot pin on which the cam 85 is mounted. Pin 83, which is located near the forward lower end of the hook plate 72, is a lower end stop for the cam 85 and pin 84, located higher on the hook plate 72, is an upper end stop for the cam 85.

The cam 85 defines an axis 87, and at one end of which is a transverse hole 88 through which the pivot pin 82 extends. At the opposite end of the cam 85 is angled surface 90 for engaging a surface on the slide bar 34 as is described below. Spaced along the surface 90 are a plurality of ripples 94, 95, 96, 97 adapted to engage a surface on the slide bar 34 as is further described below. The cam 85 also has elongate upper and lower surfaces 91, 92 respectively extending between the ends 88, 90.

Figure 11:
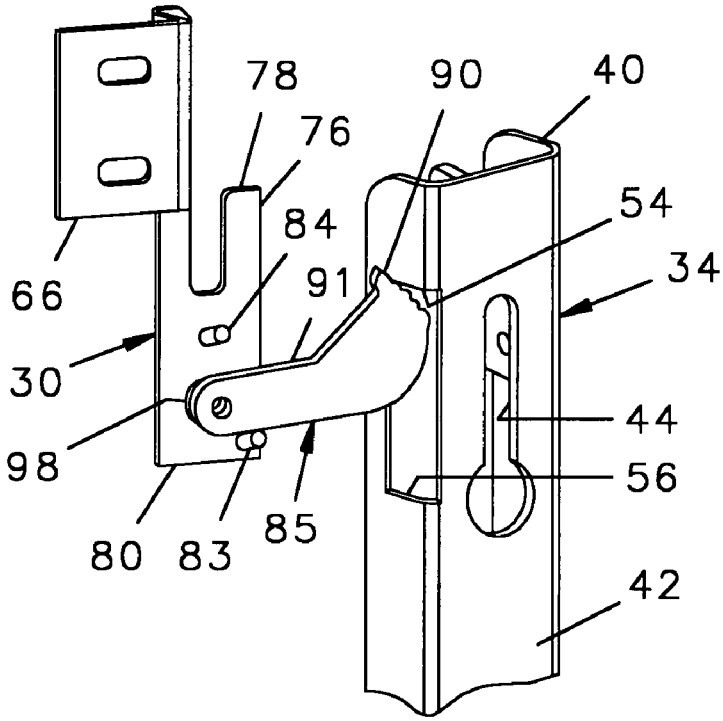
FIG. 11 is an isometric view of the hook and cam assembly shown in FIG. 10 with the engagement surface of the cam in contact with the latching plate of the latch bar shown in FIGS. 4, 5, and 6, and with parts oriented as though they were mounted to the enclosure and door of the cabinet.

Referring to FIG. 11, the cam 85 is retained in its inactive orientation with the axis 87 thereof extending generally horizontally by the first stop 83 which engages the lower surface 92 of the cam 85.

Figure 12:
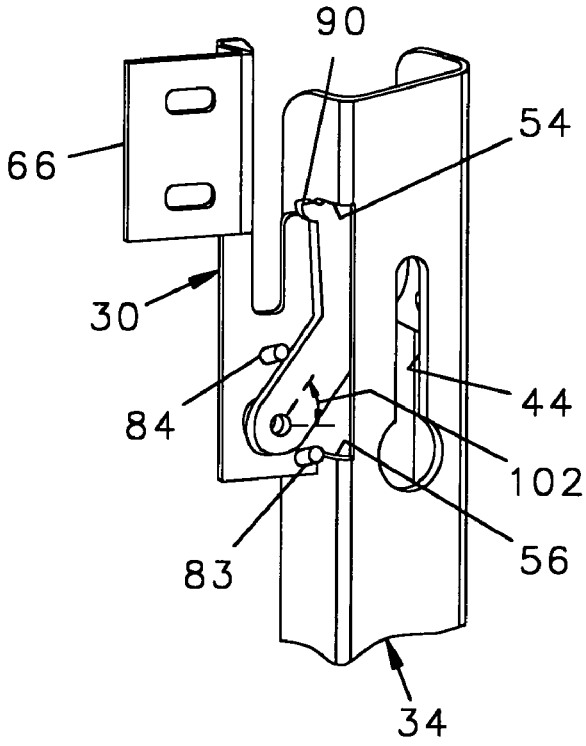
FIG. 12 is an isometric view of the hook and cam assembly in engagement with the latch bar as shown in FIG. 11, but with the cam rotated until the latch bar is elevated for receiving the hook.
Figure 13:
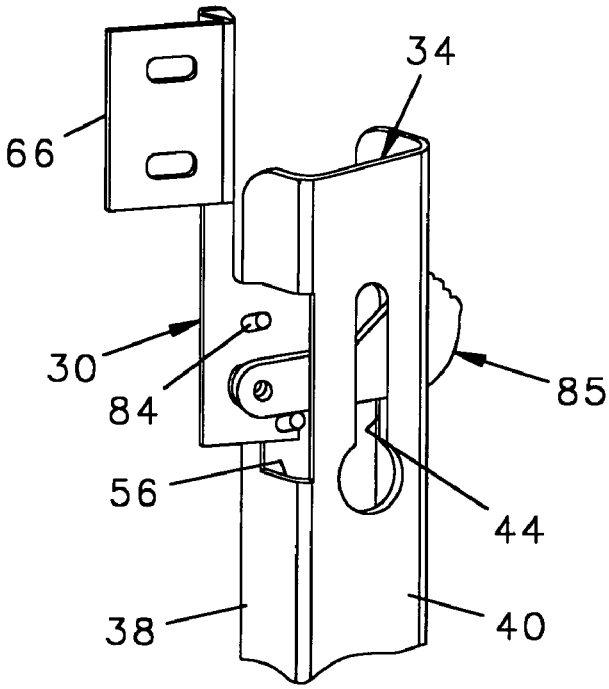
FIG. 13 is an isometric view of the hook, cam, and latch bar as shown in FIGS. 11 and 12 after the door has been fully closed, the cam released from the latch bar, and the latch plate of the latch bar engaged with the hook.

Referring to FIGS. 11, 12, and 13, the cam 85 is rotatable about the pin 82 from an inactive orientation, shown in FIG. 11 in which the axis 87 is generally horizontal, to a lifting orientation, shown in FIG. 12, in which the axis 87 of the cam 85 is rotated through an angle 102 of approximately 80 degrees. The rotation of the cam 85 beyond the lift position, shown in FIG. 12, is prevented by the contact of the upper surface 91 against the second stop 84. The cam 85 is urged by either gravity or a gentle spring 98 to return to the inactive position, with the axis 87 of the cam 85 generally horizontal as shown in FIG. 13.

Figure 4:
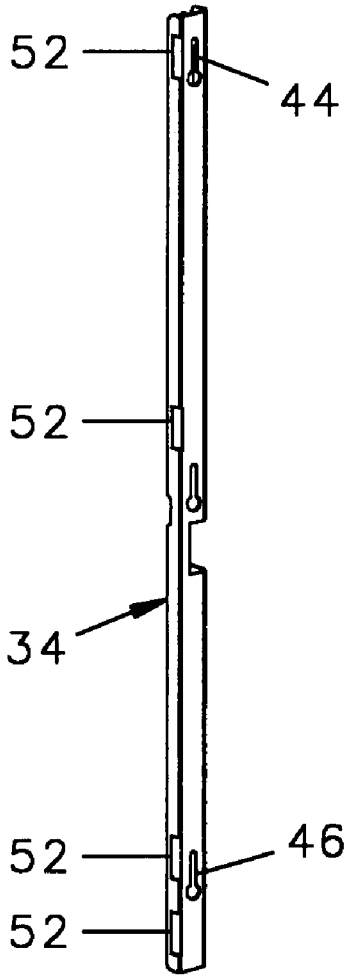
FIG. 4 is an isometric view of the latch bar shown in FIG. 3.
Figure 5:
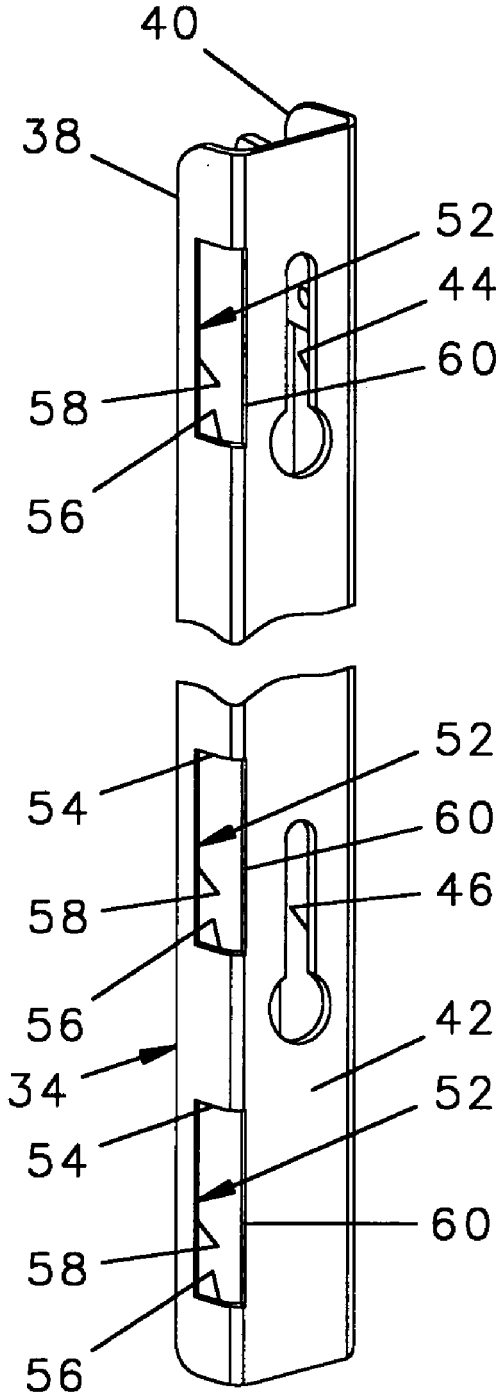
FIG. 5 is a fragmentary, greatly enlarged view of the latch bar as shown in FIG. 4.
Figure 6:
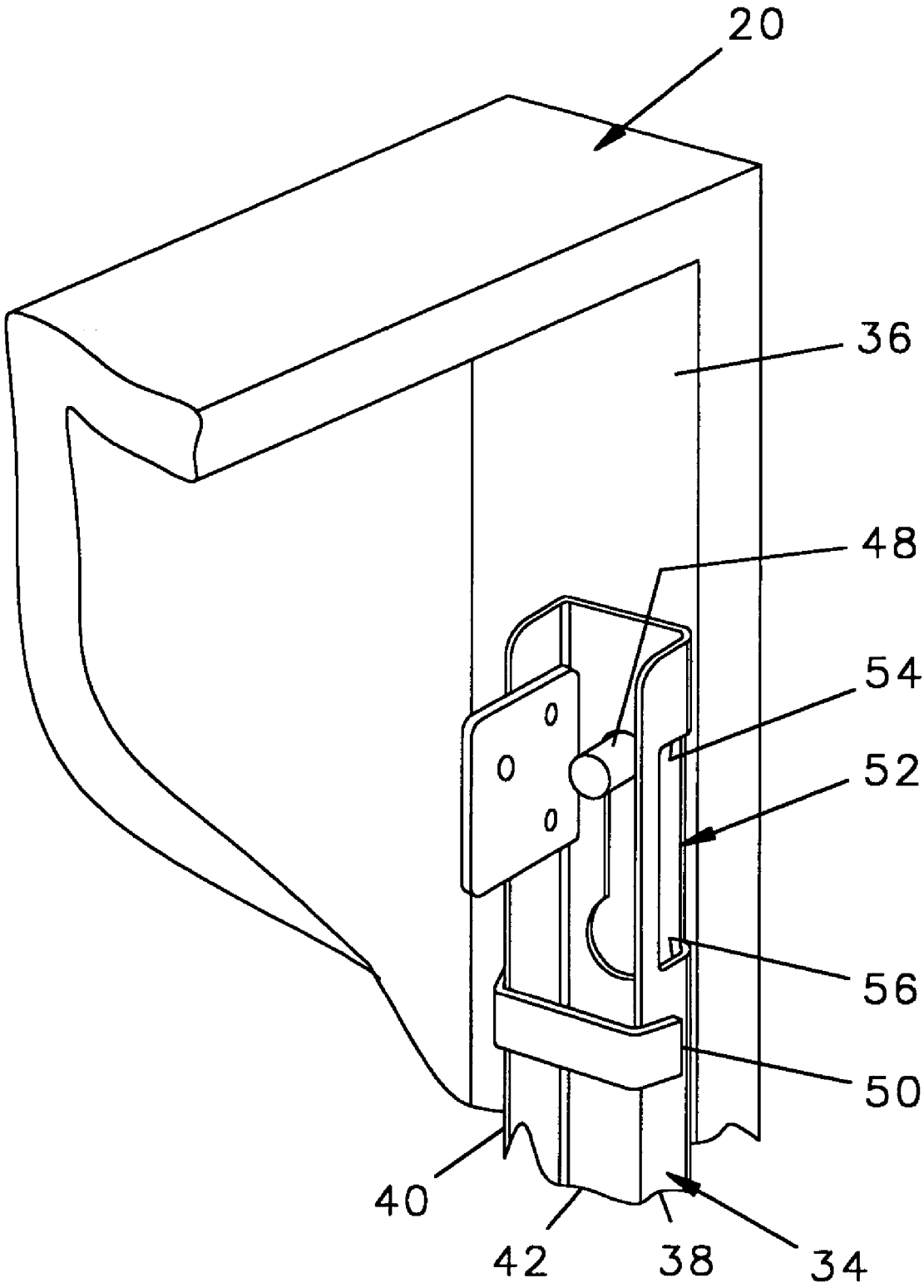
FIG. 6 is a similarly enlarged fragmentary view of the upper end of the latch bar shown in FIGS. 4 and 5 as mounted to the inner surface of the door shown in FIG. 3.

Referring to FIGS. 4, 5, and 6, the slide bar 34 is elongate, with a generally U-shaped cross section including first and second elongate side plates 38, 40 extending parallel outward of opposite sides of a elongate rectangular back plate 42. The back plate 42 has at least two elongate slots 44, 46 therein, adapted to slideably fit around a complementary pair of inwardly extending studs, mounted on the inner surface 36 of the door 20, one of which, 48, is visible in FIG. 6. The slide bar 34 is retained against the studs 48 by one or more U-shaped hooks 50, the ends of which are rigidly attached to the inner surface 36 of the door 20. The openings defined by each of the hooks 50 is a little larger than the cross sectional dimensions of the slide bar 34 to permit longitudinal movement of the slide bar 34 within the hooks 50.

The first side plate 38 of the slide bar 34 has a plurality of spaced openings 52 therein, with each of the openings 52 defined by an upper surface 54, a lower surface 56, and parallel spaced apart elongate side surfaces 58, 60.

Referring to FIGS. 5 through 13, the upper and lower surfaces 54, 56 of each opening 52 are spaced sufficiently far apart to permit the upper and lower ends 78, 80 of the tooth 76 of each of the hooks 30, 32 to pass therethrough. The openings 52 are positioned along the first side plate 38 at locations that are adjacent the hooks 30, 32 mounted on the frame surface 16 of the enclosure 12 and the elongate slots 44, 46 permit vertical movement of the slide bar 34 between a first lowered position, shown in FIGS. 6, 10, and 11, and a second elevated position, shown in FIG. 9 in which the upper and lower surfaces 54, 56 of the openings 52 are positioned to permit the upper and lower ends 78, 80 of the tooth 76 to pass therethrough.

Referring to FIG. 11 when the door 20 of the cabinet 10 is closed to an ajar position, the angled surface 90 of the cam 85 makes contact with the upper surface 54 defining the adjacent openings 52 in the slide bar 34. The edge of the upper surface 54 engages one of the indentations 94–97 on the surface 90 thereby preventing the surface 90 of the cam 85 from sliding under the upper surface 54 of the slide bar 34.

Referring to FIG. 12, as the door is moved from the ajar position towards the closed position, the movement of the door causes the cam 85 to turn around the pivot pin 82, thereby rotating the axis 87 through the angle 102 into the generally horizontal orientation at which time the upper surface 91 thereof contacts to second stop 84. The rotation of the cam 85 urges the slide bar 34 upwardly to the upper limit of the slideable movement permitted by the elongate slots 44, 46. With the slide bar 34 in the elevated, second position, the upper surfaces 54 of all the openings 52 are higher than the upper ends 78 of the teeth 76 of the hooks 30, 32. As the door 20 continues to close the upper and lower ends 78, 80 of the hook plate 72 move between the upper and lower surfaces 54, 56 of the openings 52. With the cam 85 rotated to the elevated orientation, the angled surface 90 will be substantially horizontal, allowing the surface 90 of the cam 85 to slip under the lower surface 54 of the associated opening 52.

Referring to FIG. 13, when the door 20 reaches the fully closed position the upper surface 54 of the slide bar 34 is completely off the surface 90 of the cam 85 thereby allowing gravity to draw the slide bar 34 downwardly to the lowered first position. As the slide bar moves downward the metal above the upper surfaces 54 of side plate 38 engages behind the upwardly projecting tooth 76 of the hooks 30, 32 thereby latching the door closed. Also, once the cam 85 has been pushed from beneath the upper surface 54, gravity or the spring 98, will urge the cam 85 to rotate about the pivot pin 82 until the axis 87 thereof is again generally horizontal. The door is then fully latched shut.

Figure 3:
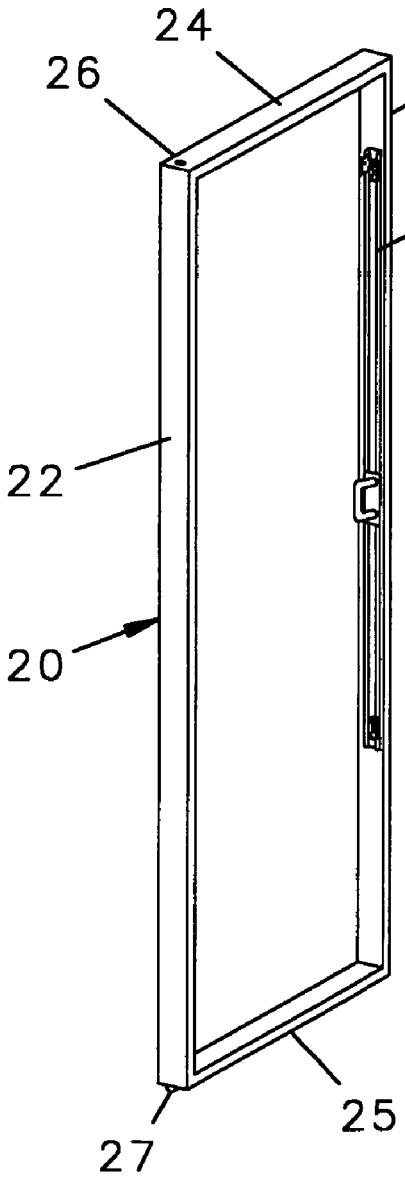
FIG. 3 is an isometric view of the latch bar slideably mounted on the inside of door shown in FIG. 1.
Figure 3A:
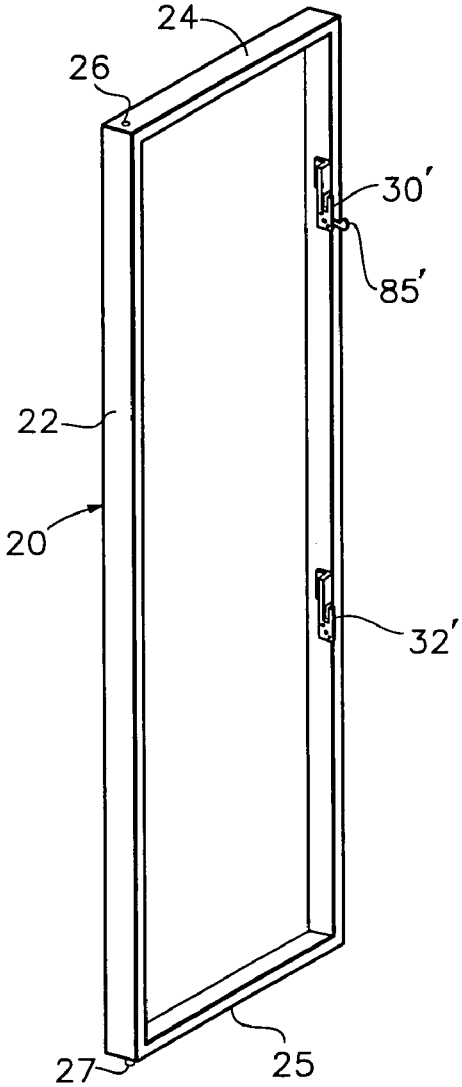
Figure 2A:
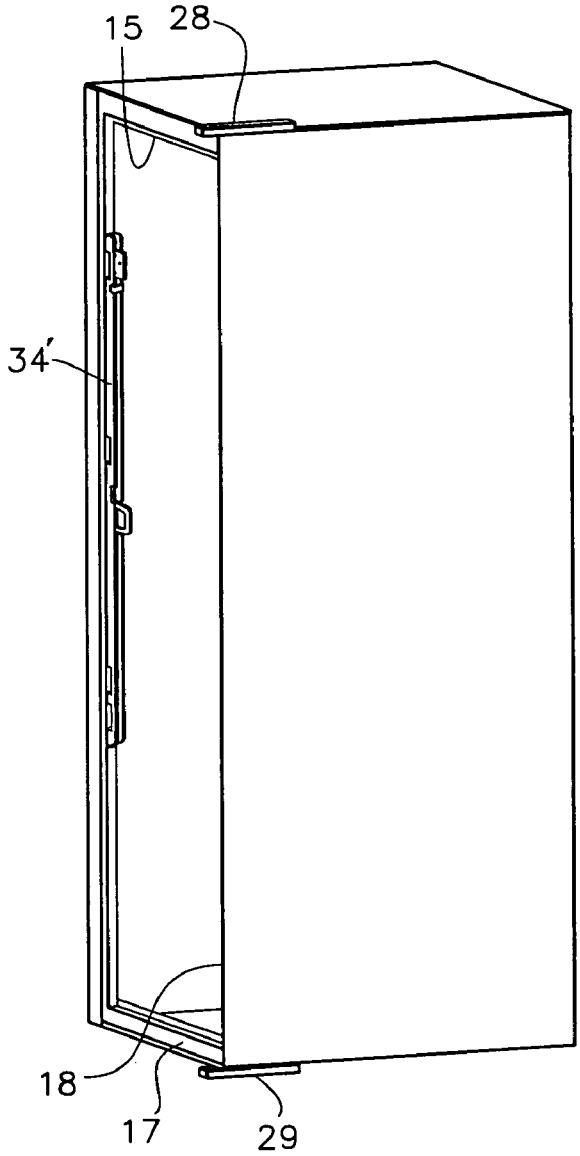

There has therefore been disclosed a device for lifting the latch bar over the upwardly extending finger of a hook as the door of an enclosure is closed against the door frame. Accordingly, latch bar 34 can be raised for latching the door without requiring the actuation of a solenoid, not shown. Referring to FIGS. 2A and 3A, it should also be appreciated that the elements of the device can easily be reversed such that the hooks 30', 32' can be mounted on the door 20 and the slide bar 34' mounted on the cabinet 12 without departing from the invention.

While the present invention has been described with respect to a single embodiment, many modifications and variations may be made without departing from the true spirit and scope of the invention. It is therefore the intent of the appended claims to cover all such modifications and variations which fall within the true spirit and scope of invention.

What is claimed:

1. A device for latching a cabinet door against an enclosure, said device comprising a hook on one of said door and said enclosure, a moveable latch member in the other of said door and said enclosure wherein one of said hook and said latch member is moveable toward and away from said other of said hook and said latch member as said door is opened and closed against said enclosure, said latch member moveable between a first latching position and a second release position, engagement means on said latch member for engaging said hook when said latch member is in said first position for retaining said door against said enclosure, means for urging said latch member toward said first position, a cam on said one of said door and said enclosure, said cam having an axis about which said cam is rotatable and a cam surface having a component parallel to said axis, said latch member having a contact surface for engaging said cam surface and causing rotation of said cam as said door is closed against said enclosure wherein said rotation of said cam moves said latch member from said first position to said second position.

2. The device of claim 1 and further comprising a releasing member for releasing said cam from said engagement with said latch member when said door has been fully closed against said enclosure wherein said latch member is thereafter urged into said second position and said engagement means engages said hook to latch said door.

3. The device of claim 1 wherein said cam is mounted on said hook.

4. The device of claim 1 wherein said engagement means is a metal plate.

5. The device of claim 1 wherein said cam is rotatable between a standby orientation in which said cam is not engaged with said latch member and an actuated orientation in which said latch member is moved to said second position.

6. The device of claim 5 and further comprising means to urge said cam from said actuated orientation to said standby orientation.

7. The device of claim 6 wherein said means to urge is a spring.

8. In a cabinet having a door that closes against an opening in said cabinet and having a hook on one of said door and said cabinet, a slide bar on the other of said door and said cabinet, said slide bar moveable between a first position and a second position, the improvement comprising a cam on said hook, and said cam having a surface for engaging said slide bar and moving said slide bar from said first position to said second position.

9. The improvement of claim 8 wherein said cam is rotatable between a standby orientation in which said cam is not engaged with said latch bar and an actuating orientation in which said latch bar is moved to said second position.

10. The improvement of claim 8 and further comprising means for urging said latch bar from said second position toward said first position.

11. The improvement of claim 10 and further comprising a release member for releasing said cam from said engagement with said slide bar when said door has been fully closed against said opening wherein said slide bar is released to move to said first position to thereby latch said door.

12. In a cabinet having a door that closes against an opening in said cabinet and having a hook on one of said door and said cabinet, a slide bar on the other of said door and said cabinet, said slide bar moveable between a first position and a second position, the improvement comprising a cam on said one of said door and said cabinet, and said cam having a surface for engaging said slide bar and moving said slide bar from said first position to said second position wherein said cam is rotatable between a standby orientation in which said cam is not engaged with said latch bar and an actuating orientation in which said latch bar is moved to said second position.

13. In a cabinet having a door that closes against an opening in said cabinet and having a hook on one of said door and said cabinet, a slide bar on the other of said door and said cabinet, said slide bar moveable between a first latching position and a second release position, the improvement comprising a cam on said one of said door and said cabinet, said cam having a surface for engaging said slide bar and moving said slide bar from said first position to said second position, and a releasing member for releasing said cam member from engagement with said slide bar cam when said door has been fully closed against said enclosure wherein said slide bar is thereafter urged into said first position and engages said hook to latch said door.

14. The improvement of claim 13 and further comprising means for urging said latch bar from said second position toward said first position.

* * * * *

UNITED STATES PATENT AND TRADEMARK OFFICE

CERTIFICATE OF CORRECTION

PATENT NO. : 7,168,745 B2
APPLICATION NO. : 10/952094
DATED : January 30, 2007
INVENTOR(S) : Mohammad Ali Jamnia It is certified that error appears in the above-identified patent and that said Letters Patent is hereby corrected as shown below:

In Column 1, Line 42 after "the" first occurrence, insert --access--

In Column 3, after Line 29 and before line 30 insert --2A is an isometric view of another cabinet in which the latch bar is in the cabinet rather than in the door;--

In Column 3 after Line 31 and before Line 32 insert --3A is an isometric view of another door having the hooks therein rather than the latch bar;--

In Column 8, Line 16 after "bar" delete "cam"

Signed and Sealed this

Eighteenth Day of March, 2008

JON W. DUDAS
*Director of the United States Patent and Trademark Office*